United States Patent [19]

Nishio et al.

[11] 4,217,873

[45] Aug. 19, 1980

[54] IGNITION CIRCUIT FOR SELF-PURIFYING CREEPING DISCHARGE SPARK PLUGS

[75] Inventors: Kanemitsu Nishio, Komaki; Takashi Suzuki, Nagoya; Toshihiko Uenaga, Iwata; Fumio Zega, Hamamatsu, all of Japan

[73] Assignees: NGK Spark Plug Co. Ltd.; Yamahara Hatsudoki Kabushiki Kaisha, both of

[21] Appl. No.: 870,436

[22] Filed: Jan. 18, 1978

[30] Foreign Application Priority Data

Jan. 25, 1977 [JP] Japan ..... 52-7050

[51] Int. Cl.[3] ..... F02P 1/00

[52] U.S. Cl. ..... 123/653; 315/209 M; 123/605; 123/647; 123/655

[58] Field of Search .... 123/148 A, 148 AC, 148 DC, 123/148 E; 315/209 M

[56] References Cited

U.S. PATENT DOCUMENTS

| | | | |
|---|---|---|---|
| 2,247,075 | 6/1941 | Wilkinson | 123/148 A |
| 2,571,788 | 10/1951 | Tognola | 123/148 DC |
| 4,083,347 | 4/1978 | Grather | 123/148 DC |

*Primary Examiner*—Ronald B. Cox

*Attorney, Agent, or Firm*—Stevens, Davis, Miller & Mosher

[57] ABSTRACT

An ignition circuit for self-purifying creeping discharge spark plugs is disclosed. The ignition circuit comprises a creeping discharge spark plug including a center electrode and a concentric ground electrode between which is formed a spark gap having a creeping surface along which sparks are slidably moved, a capacitor located near said spark gap and connected in parallel therewith, and an impedance element connected in series with said capacitor and not impeding the movement of the electric charge discharged from said capacitor.

5 Claims, 27 Drawing Figures

IGNITION CIRCUIT FOR SELF-PURIFYING CREEPING DISCHARGE SPARK PLUGS

BACKGROUND OF THE INVENTION

1. Field of the Invention

This invention relates to an ignition circuit for self-purifying creeping discharge spark plugs.

2. Description of the Prior Art

Combustion gas created in internal combustion engines contains carbon composite other than gas containing carbon tar, etc. The carbon composite adheres to and is deposited on the insulator surface of a spark plug causing the insulation resistance of the spark plug to decrease. Such a decrease of the insulation resistance of the spark plug causes a sudden voltage drop in an ignition device having a large output impedance. In this case, if the output voltage of the ignition device becomes lower than the voltage required for producing sparks across the spark plug, no spark discharge occurs which results in a so-called misfire of the spark plug.

The misfire of the spark plug must be avoided to decrease the emission of unburnt exhaust gas from the internal combustion engine. In order to prevent the insulation resistance of the spark plug from decreasing owing to carbon compound adhered to and deposited on the insulator surface of the spark plug, many attempts have been made to design the spark plug such that the front end of the insulator is subject to high temperature so as to burn the carbon composite deposited on the insulator surface, that is, to improve the heat self-purifying property of the spark plug.

In general, the internal combustion engine is operated under such conditions that its speed is changed for a wide range between an idling speed domain and a full speed domain, and as a result, the temperature of the front end of the insulator under the full speed domain becomes significantly higher than that under the idling speed domain. As a result, if the temperature of the front end of the insulator is established such that its temperature reaches a magnitude at which the carbon composite adhered to and deposited on the insulator surface becomes burnt under the idling speed domain, the front end of the insulator becomes excessively heated under the full speed domain, thereby inducing premature ignition. In general, it has been very difficult to design the spark plug on the basis of its heat self-purifying property such that the spark plug can operate without decreasing the insulation resistance of the spark plug due to the carbon composite adhered to and deposited on the insulator surface of the spark plug under the low speed domain without inducing the premature ignition under the full speed domain.

Recently, it has eagerly been requested to provide an ignition system which can avoid a misfire of the spark plug even when the temperature at the front end of the insulator becomes high preventing premature ignition and which can purify the exhaust gas from the internal combustion engine without deteriorating its performance.

It might be possible to provide an ignition system which can operate for a wide temperature range if the self-purifying property of the spark plug is electrically attained without recourse to the conventional spark plug which makes use of its heat self-purifying property. Attempts have been made to provide a capacitor discharge ignition device for electrically removing the carbon composite adhered to and deposited on the discharge path of a creeping discharge spark plug since the creeping discharge spark plug has been developed.

In such conventional capacitor discharge ignition device, use is made of an oscillation step-up circuit including, for example, a transistor type DC-DC converter so as to increase a battery voltage up to several hundred volts. In this case, the battery functions to charge a capacitor. Provision is also made of a silicon controlled rectifier having a gate supplied with a pulse signal so as to discharge the electric charge of the capacitor through a primary winding of an ignition coil. A secondary voltage induced in a secondary winding of the ignition coil is rapidly stepped up, and as a result, the discharge voltage at the secondary winding is kept substantially constant irrespective of a leakage resistance due to contamination of the spark plug, etc.

It has also been proposed to use a combination of an electric circuit comprising a capacitor and a resistor and the conventional spark plug including a center electrode and a ground electrode opposed to the center electrode and forming a spark gap therebetween through which pass sparks. In this case, the capacitor is connected in parallel with the spark gap and the resistor is connected in series with the capacitor. The use of such combination of the RC circuit and the conventional spark plug has the following drawbacks.

(1) When the engine operates at a low speed, carbon composite adhered to and deposited on the insulator can be removed by the RC circuit. But, the step of removing the carbon composite is effected independently of the spark discharging or firing step, so that considerable energy is consumed in the carbon composite removing step, thereby reducing the energy required for firing the air-fuel mixture gas in the combustion chamber.

(2) When the engine operates at a high speed, the RC circuit produces a large discharge current that tends to deteriorate the electrodes.

An outboard engine is used under two extremely different conditions, i.e. used at a low speed in the case of, for example, idling, trawling, etc. and used also at a high speed for a long time in the case of fully opening throttle valves, and must satisfy those two conditions and hence must be provided with a wide temperature range spark plug. Such a wide temperature range spark plug having an excellent reliability and durability and particularly adapted for outboard engines is now urgently in demand.

SUMMARY OF THE INVENTION

An object of the invention, thereof, is to provide an ignition circuit for self-purifying creeping discharge spark plugs, which can eliminate the above mentioned drawbacks which have been encountered with the prior art techniques.

Another object of the invention is to provide an ignition circuit for self-purifying creeping discharge spark plugs, which can electrically remove carbon composite adhered to and deposited on the discharge path of the creeping discharge spark plug in a reliable manner without excessive deterioration of the electrodes.

A further object of the invention is to provide an ignition circuit for self-purifying creeping discharge spark plugs, which can render it possible to provide a wide temperature range spark plug having an excellent reliability and durability and particularly adapted for outboard engines.

DETAILED DESCRIPTION OF THE PREFERRED EMBODIMENTS

In FIGS. 1*a* to 1*h* are shown various kinds of ignition circuits to be tested for comparing respective electrical self-purifying properties.

Referring to FIGS. 1*a* to 1*h*, $T_2$ designates a secondary winding of an ignition coil, P a spark gap of a creeping discharge spark plug, R a resistor, C a capacitor, L an inductor, and D a diode.

Figure 8:
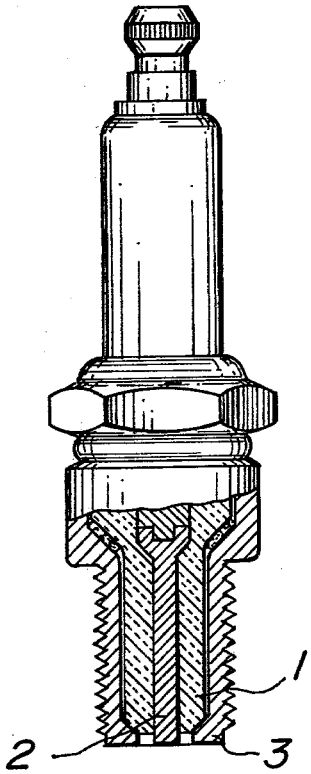
FIG. 8 is a front elevational view of a full-creeping discharge plug, a part being shown in section.
Figure 9:
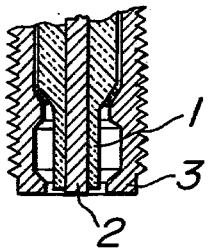
FIG. 9 is a sectional view of a semi-creeping discharge plug.

The creeping discharge spark plug shall be understood to include not only a full-creeping discharge plug shown in FIG. 8 and producing sparks along the surface of an insulator igniting portion 1 formed between a center electrode 2 and a concentric ground electrode 3, but also a semi-creeping discharge plug shown in FIG. 9 and comprising a creeping gap formed between the center electrode 2 and the surface of the insulator igniting portion 1 and having an air gap formed between the peripheral surface of the insulator igniting portion 1 and the concentric ground electrode 3.

Figure 1A:
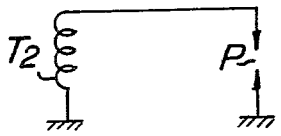
FIGS. 1*a* to 1*h* are diagrams of various kinds of ignition circuits to be tested for comparing respective electrical self-purifying properties.

In the ignition circuit shown in FIG. 1*a*, the secondary winding $T_2$ of the ignition coil is directly connected to the spark gap P. This is a standard condition.

Figure 1B:
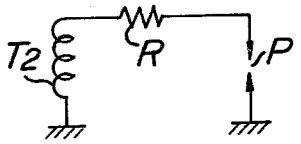

In the ignition circuit shown in FIG. 1*b*, use is made of a concentration type or distribution type resistor R which is connected in series with the spark gap P. The resistance value of the resistor R is made changeable in a range between 100 Ω and 30 KΩ.

Figure 1C:
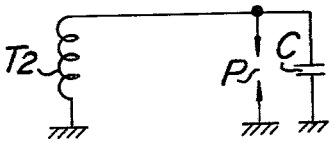

In the ignition circuit shown in FIG. 1*c*, the capacitor C is connected in parallel with the spark gap P and the capacity of the capacitor C is made changeable in a range between 20 pF and 200 pF.

Figure 1D:
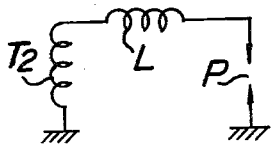

In the ignition circuit shown in FIG. 1*d*, the inductor L is connected in series with the spark gap P and the inductance value of the inductor L is made changeable in a range between 1 μH and 100 mH.

Figure 1E:
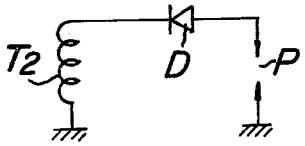

In the ignition circuit shown in FIG. 1*e*, the diode D is connected in series with the spark gap P.

Figure 1F:
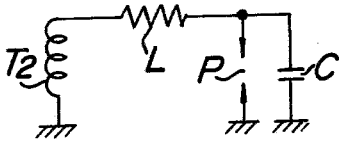

In the ignition circuit shown in FIG. 1*f*, the ignition circuit shown in FIG. 1*b* is combined with the ignition circuit shown in FIG. 1*c*.

Figure 1G:
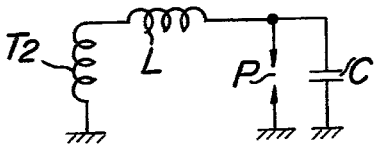

In the ignition circuit shown in FIG. 1*g*, the ignition circuit shown in FIG. 1*c* is combined with the ignition circuit shown in FIG. 1*d*.

Figure 1H:
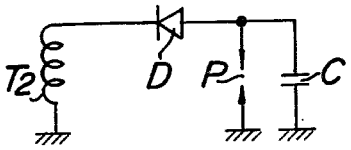

In the ignition circuit shown in FIG. 1*h*, the ignition circuit shown in FIG. 1*c* is combined with the ignition circuit shown in FIG. 1*e*.

Figure 2A:
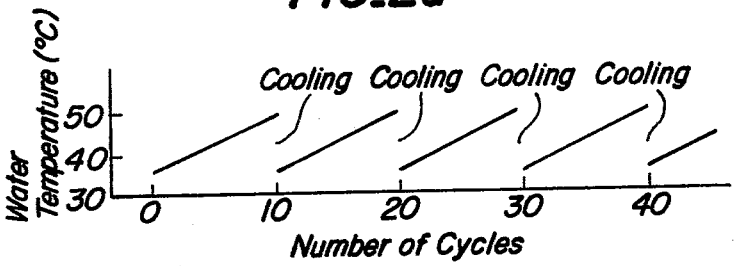
FIGS. 2*a* and 2*b* are graphs illustrating test patterns of an internal combustion engine under contamination tests.
Figure 2B:
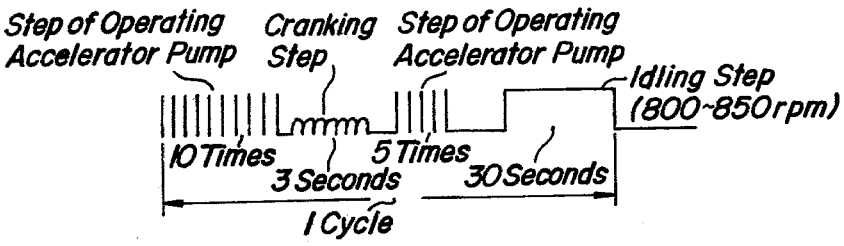

In FIGS. 2*a* and 2*b* are shown test patterns of an internal combustion engine. The ignition circuits shown in FIGS. 1*a* to 1*h* were tested on change of insulation resistance of the spark plug as a function of the number of cycles of the test patterns shown in FIGS. 2*a* and 2*b* until the internal combustion engine stops.

The experimental tests were effected under the following conditions. Use was made of a 1,600 cc 4 cylinder 4 stroke cycle engine provided with a semi-creeping discharge plug. Applied voltage was 40 kv with a rise time of 45 μs. Use was made of a full transistor ignition device having an output impedance of about 500 KΩ.

The engine was operated under the following conditions. Number of revolutions 800 to 850 rpm, a suction pressure of 420 to 440 mmHg, a water temperature of 30° to 50° C., an oil temperature of 30° to 50° C., an oil pressure of 30 kg/cm$^2$, an amount of flow of fuel of 5.0 l/hr and a choke ratio of 9/10. The engine was cooled at intervals of every 10 cycles as shown in FIG. 2*a*. Each cycle comprised successive steps including a step of operating an accelerator pump, a cranking step, a step of operating the accelerator pump and an idling step as shown in FIG. 2*b*. At the end of 1 cycle, the insulation resistance of the spark plug was measured.

Figure 3:
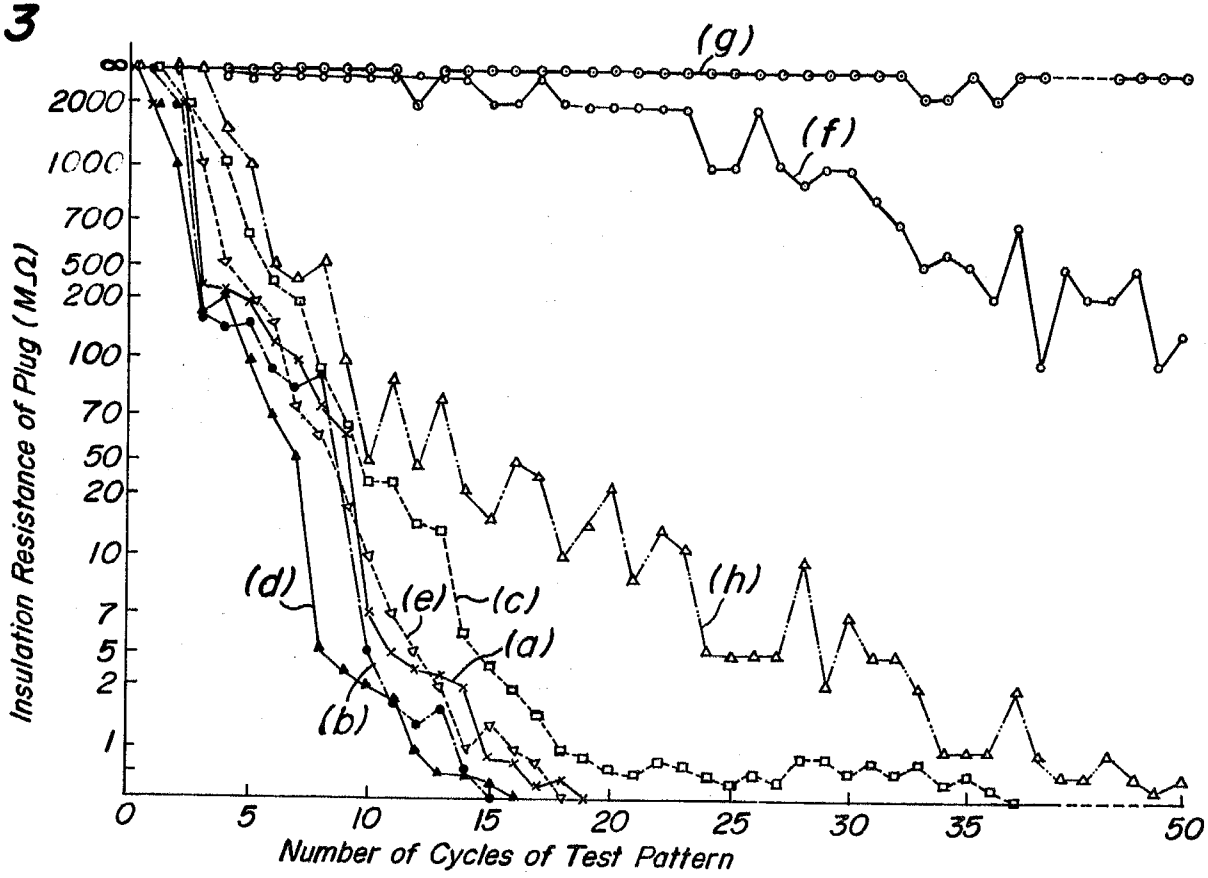
FIG. 3 is a graph showing the result yielded from contamination tests effected on the ignition circuits shown in FIGS. 1*a* to 1*h;*

In FIG. 3 there is shown a decrease of the insulation resistance of the creeping discharge spark plug as a function of the number of cycles of the test pattern until the engine becomes stopped for the ignition circuits shown in FIGS. 1*a* to 1*h* by curves a to h corresponding to the ignition circuits shown in FIGS. 1*a* to 1*h*, respectively. As seen from FIG. 3, the ignition circuits shown in FIGS. 1*f* and 1*g* are significantly effective and the ignition circuit shown in FIG. 1*h* is effective next to the ignition circuits shown in FIGS. 1*f* and 1*g*. The experimental tests have yielded the result that the position of the capacitor C relative to the plug gap P plays a very important role for the purpose of exhibiting the self-purifying effect of the ignition circuit according to the invention.

In FIGS. 4*a* to 4*d* are shown other various kinds of ignition circuits to be tested for comparing respective electrical self-purifying properties.

Figure 4A:
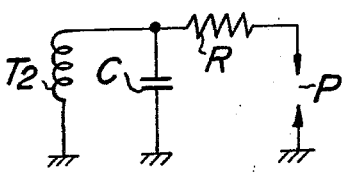
FIGS. 4*a* to 4*d* are diagrams of another various kinds of ignition circuits to be tested for comparing respective electrical self-purifying properties.

In the ignition circuit shown in FIG. 4*a*, the electric charge of the capacitor C is discharged through the resistor R into the spark gap P.

Figure 4B:
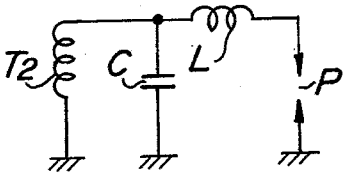

In the ignition circuit shown in FIG. 4*b*, the electric charge of the capacitor C is discharged through the inductor L into the spark gap P.

Figure 4C:
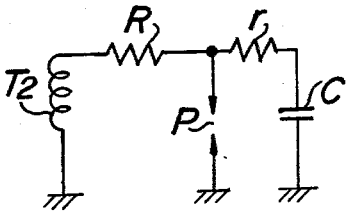

In the ignition circuit shown in FIG. 4*c*, use is made of an auxiliary resistor r whose resistance value is about 1/10 smaller than that of the resistor R and the electric charge of the capacitor C is discharged through the auxiliary resistor r into the spark gap P.

Figure 4D:
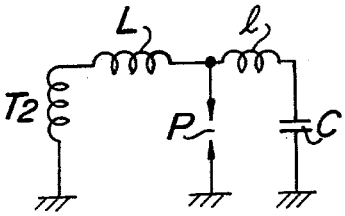

In the ignition circuit shown in FIG. 4*d*, use is made of an auxiliary inductor l whose inductance value is about 1/10 smaller than that of the inductor L and the electric charge of the capacitor C is discharged through the auxiliary inductor l into the spark gap P.

The ignition circuits shown in FIGS. 4*a* to 4*d* were tested under the test patterns shown in FIGS. 2*a* and 2*b* determining the change of insulation resistance of the creeping discharge spark plug as a function of the number of cycles of the test patterns until the engine operation becomes stopped. The experimental tests were effected under the same conditions as those described with reference to the ignition circuits shown in FIGS. 1*a* to 1*h*.

Figure 5:
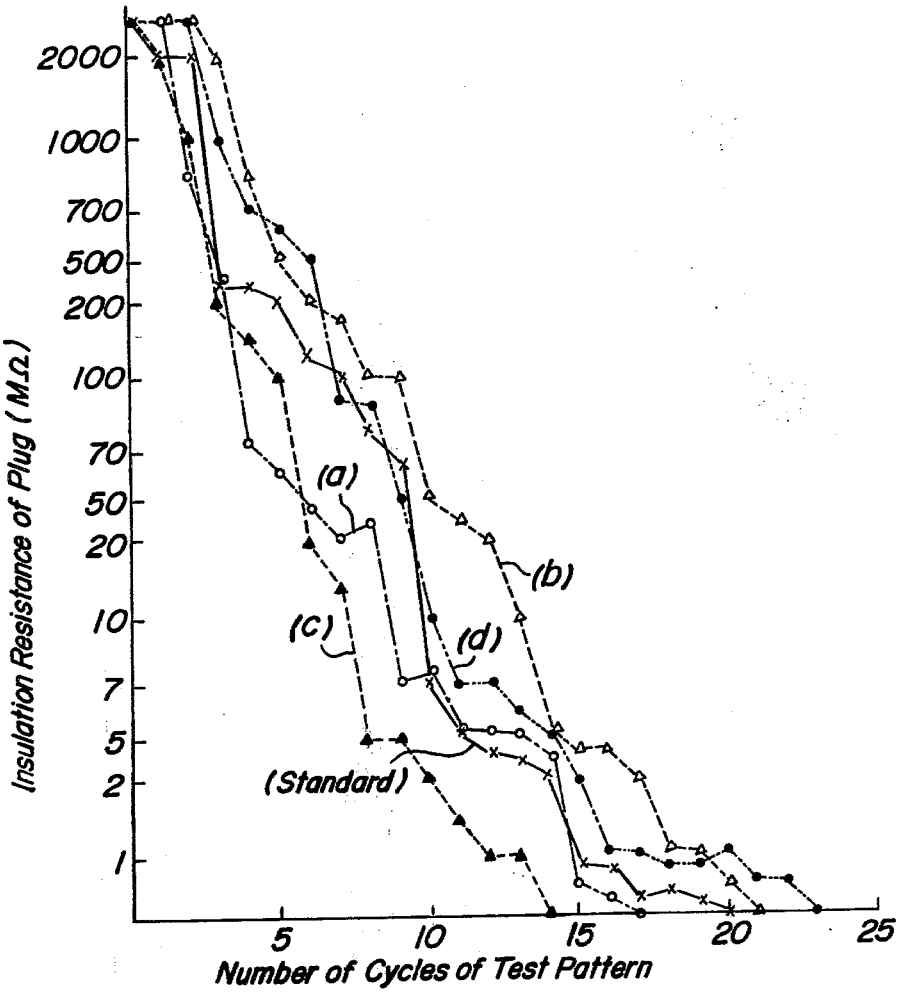
FIG. 5 is a graph showing the results from contamination tests effected on the ignition circuits shown in FIGS. 4*a* to 4*d;*

In FIG. 5 the test results yielded from the contamination tests effected on the ignition circuits shown in FIGS. 4*a* to 4*d* by curves a to d are shown. As seen from comparison between FIG. 5 and FIG. 3, all of the ignition circuits shown in FIGS. 4*a* to 4*d* are not effective.

Judging from the above test results, it is necessary for obtaining the self-purifying effect of the ignition circuit according to the invention to satisfy the following three conditions (1) to (3).

(1) The capacitor C must be directly connected to that point of the ignition circuit which is located as near as possible to the spark gap P without passing through R, L, etc.

(2) R and L must be connected in series with the spark gap P and must always be located at the side of the ignition coil T rather than the side of the connection point of the spark gap P with the capacitor C.

(3) The electric charge of the capacitor C must be directly discharged into the spark gap P and R, L, D must always be connected in series with the spark gap P.

The diode D is also effective, but poor in withstanding voltage applied thereto, so that it is preferable to use the inductor L or resistor R instead of the diode D for the purpose of operating the circuit in a stable state.

As seen from the above, the suitable connection and arrangement of R, L and C ensures a significant improvement that can prevent the creeping discharge spark plug from being contaminated with carbon.

Figure 6:
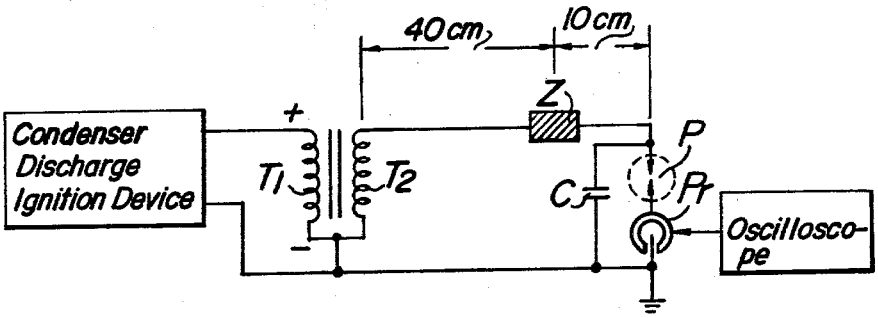
FIG. 6 is a diagram of a measuring circuit for observing the discharge current flowing through a spark gap of a creeping discharge spark plug according to the invention.
Figure 7A:
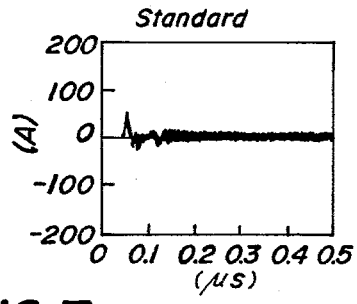
FIGS. 7*a* to 7*h* are oscillograms showing a discharge current A of the ignition circuits shown in FIGS. 1*a* to 1*h* as a function of time μs and observed by the measuring circuit shown in FIG. 6.
Figure 7B:
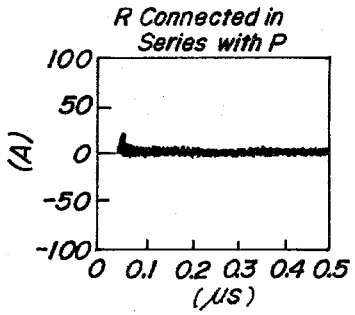
Figure 7C:
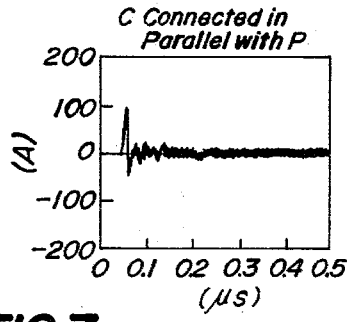
Figure 7D:
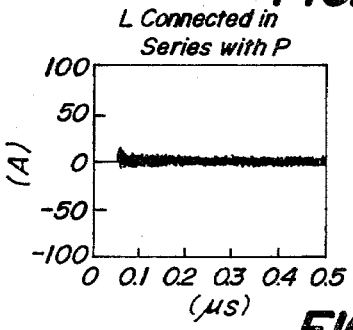
Figure 7E:
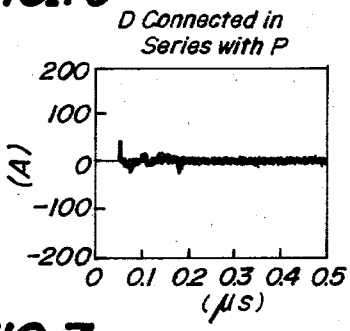
Figure 7F:
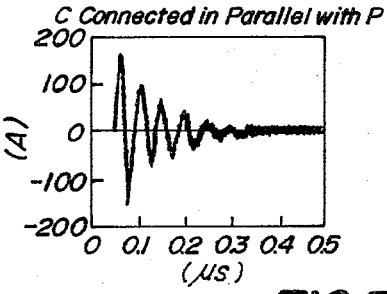
Figure 7G:
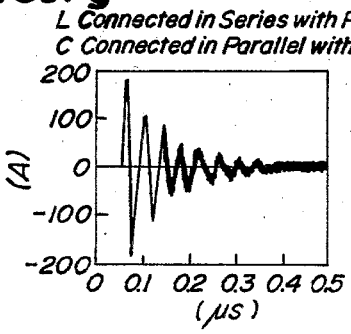
Figure 7H:
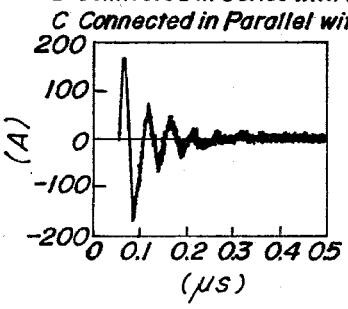

In FIG. 6 a measuring circuit is shown for observing the discharge current flowing in a spark gap of a creeping discharge spark plug. In the measuring circuit shown in FIG. 6, an impedance element Z inclusive of R, L and D and distant apart from a secondary winding $T_2$ of an ignition coil T by 40 cm and distant apart from a spark gap P by 10 cm was connected in series with the spark gap P, and a capacitor C having an electrostatic capacity of 100 pF was connected in parallel with the spark gap P. The capacitor C was located at a position such that the discharge of the electric charge of the capacitor C is not disturbed by the presence of the impedance element Z. Across a primary winding $T_1$ of the ignition coil T was connected a contactless capacitor discharge ignition device which can generate a voltage of about 40 kv and having a rise time of about 50 μs in a chamber under a pressure of 3 kg/cm$^2$ so as to discharge the capacitor C. The igniton coil T is a supercoil type made by Hanshin Coil Co. in Japan.

The spark gap P was connected through a current probe Pr of MODEL 94111-1·1000 MHz made by Singer Co. in U.S.A. and a coaxial cable Co of 50 Ω to a Techtronix 7904 type oscilloscope of 500 MHz, 10 mvtr: 0.8 ns. Use was made of an attenuator of 50 Ω±5% made by Techtronix Co. in U.S.A. so as to measure an impedance value of the impedance element Z. Then, the discharge current of the capacitor C was measured.

In FIGS. 7*a* to 7*h* are shown oscillograms illustrating a discharge current A of the ignition circuits shown in FIGS. 1*a* to 1*h* as a function of time μs and observed by the measuring circuit shown in FIG. 6. As seen from FIGS. 7*f* and 7*g*, both the ignition circuit shown in FIG. 1*f* and comprising the resistor R connected in series with the spark gap P and the capacitor C connected in parallel with the spark gap P and the ignition circuit shown in FIG. 1*g* and comprising the inductor L connected in series with the spark gap P and the capacitor C connected in parallel with the spark gap P produce oscillation phenomena which are far superior to those produced by the remaining ignition circuits, thereby increasing the discharge current and maintaining such discharge current for a considerably long time.

As to the oscillation phenomena, the larger the capacity of the capacitor C the larger the discharge current. But, if the capacity of the capacitor C becomes larger than 200 pF, the spark voltage becomes significantly lowered, so that an allowable upper limit of the capacity of the capacitor C should be 200 pF. In addition, a lower limit of the capacity of the capacitor C should be 20 pF. Moreover, if the impedance Z is determined to a value within a range defined by the present invention, substantially no change is subjected to the oscillation frequency and no adverse influence is exerted to the discharge characteristic of the creeping discharge spark plug. In addition, the capacity discharge spark is discharged along the creeping surface of the spark plug, while the induction discharge spark is discharged along that portion of the spark plug which is apart from the creeping surface thereof.

As a result, an increase of the initial capacity discharge current is effective to purify the carbon composite adhered to and deposited on the spark plug. The use of such oscillation phenomenon ensures an increase of the initial capacity discharge current in an effective manner. That is, the use of thermal properties using a cold type creeping discharge spark plug itself can prevent the premature firing at a high speed operation and the use of electrical components by adding a ZC circuit can prevent carbon composite from being adhered to and deposited on the spark plug at a low speed operation. As a result, the invention is capable of effectively eliminating the above mentioned problems which have been encountered with the prior art techniques.

The use of the combination of a creeping discharge spark plug including a spark gap having a creeping surface along which sparks slidably move and a ZC ignition circuit provides the following advantage.

(1) When the engine operates at a low speed, at the beginning of the spark forming step, the discharge sparks creep along the insulator surface to burn the carbon composite, and as a result, the igniting energy is not consumed.

(2) When the engine operates at a high speed, since the creeping discharge spark plug is composed of a center electrode and a concentric ground electrode, the amount of deterioration of the electrodes per unit area is extremely small and hence the electrodes have excellent durability even when a large discharge current passes therethrough.

The combination of the ZC circuit and the creeping discharge spark plug according to the invention especially provides the following advantage when it is applied to outboard engines.

(1) The outboard engine must be provided with a wide temperature range spark plug contrary to an engine for vehicles. That is, the outboard engine is often used not only at a low operation speed in the case of, for example, idling, trawling, etc., but also at a high operation speed for a long time in the case of fully opened throttle valves. In other words, the outboard engine is used under two extremely different conditions and must satisfy those two conditions.

(2) In the outboard engine, there is a risk of an ignition device being rendered out of order and hence dangerous to crews. That is, when the outboard engine becomes out of order, it is difficult to repair it on the sea.

As described above, the combination of ZC circuit and the creeping discharge spark plug is effective for a wide range of the engine operation and excellent in reliability and durability, so that it is particularly adapted for outboard engines.

As stated hereinabove, a combination of a creeping discharge spark plug and a ZC circuit according to the invention is capable of significantly increasing the capacity discharge current and of effectively removing the carbon composite adhered to and deposited on the discharge creeping surface by the capacity discharge energy, thereby significantly preventing the lowering of the insulation resistance of the creeping discharge spark plug as shown in FIG. 3. In addition, the use of the combination according to the invention provides the important advantage that the electrical self-purifying property can be significantly increased, that a temperature range of the creeping discharge spark plug can be made wide, and that the demand for the present times of purifying the exhaust gas can effectively be satisfied.

What is claimed is:

1. An ignition circuit for self-removing carbon deposits from discharge spark plugs, comprising a spark plug including a center electrode and a concentric ground electrode between which is formed a spark gap, said spark gap having a surface along which sparks may move, a capacitor having a capacity between 20 pf and 200 pf located physically adjacent said spark gap and electrically connected in parallel therewith with no intervening components, and an impedance element connected in series with said capacitor and not impeding the movement of electric charge discharged from said capacitor.

2. An ignition circuit for removing carbon deposits from a spark plug, said plug having first and second electrodes for receiving a high voltage for generating a spark and having a surface along which sparks may move comprising:

a capacitor located physically adjacent to said spark plug and electrically connected in parallel therewith with no intervening components said capacitor having a capacity between 20 pf and 200 pf;

a series impedance element having first and second ends, said first end being connected to said first electrode; and means for applying a high voltage between said second end and said second electrode whereby an increased discharge current is produced through said spark plug electrodes reducing the amount of carbon deposited on said spark plugs.

3. The ignition circuit according to claim 1, wherein said impedance element is composed of at least one circuit element selected from the group consisting of a direct current resistor of 0.1 to 30 KΩ, an inductor of 1 μH to 100 mH and a diode.

4. The ignition circuit according to claim 1, wherein said impedance element is composed of at least one element selected from the group consisting of a direct current resistor of 0.1 to 30 KΩ, an inductor of 1 μH to 100 mH and a diode connected in a reverse direction.

5. The ignition circuit according to claim 1, wherein said ignition circuit is applied to an outboard engine.

* * * * *